US007862368B1

(12) United States Patent
Lai et al.

(10) Patent No.: US 7,862,368 B1
(45) Date of Patent: Jan. 4, 2011

(54) SOCKET ASSEMBLY

(75) Inventors: Chih-Ming Lai, Taipei Hsien (TW); Yung-Shun Kao, Taipei Hsien (TW)

(73) Assignee: Giga-Byte Technology Co., Ltd., Taipei Hsien (TW)

( * ) Notice: Subject to any disclaimer, the term of this patent is extended or adjusted under 35 U.S.C. 154(b) by 0 days.

(21) Appl. No.: 12/540,103

(22) Filed: Aug. 12, 2009

(51) Int. Cl.
*H01R 13/62* (2006.01)

(52) U.S. Cl. ..... 439/358

(58) Field of Classification Search ..... 439/358, 439/357

See application file for complete search history.

(56) References Cited

U.S. PATENT DOCUMENTS 5,494,452 A * 2/1996 Matsumoto et al. ..... 439/358
6,149,451 A * 11/2000 Weber ..... 439/358
6,234,828 B1 * 5/2001 Kuo ..... 439/358
6,565,383 B1 * 5/2003 Wu ..... 439/567
6,585,537 B1 * 7/2003 Lee ..... 439/358
2003/0228788 A1 * 12/2003 Igarashi et al. ..... 439/358
2006/0199418 A1 * 9/2006 Chang ..... 439/358

* cited by examiner

*Primary Examiner*—Gary F. Paumen
(74) *Attorney, Agent, or Firm*—Chun-Ming Shih

(57) ABSTRACT

A socket assembly includes a socket, a connection terminal, and a snap-fit member. The connection terminal is plugged into the socket. The snap-fit member includes a main body, a positioning portion, and a snap-fit portion. The positioning portion and the snap-fit portion are connected to the main body. The positioning portion is locked with the socket. The main body is pivotable between a first position and a second position about the portioning portion. The snap-fit portion is snappingly engaged with the connection terminal when the snap-fit portion is in the first position. The snap-fit portion is disengaged from the connection terminal when the snap-fit portion is in the second position.

18 Claims, 4 Drawing Sheets

10

SOCKET ASSEMBLY

BACKGROUND

1. Field of the Invention

The present invention relates to a socket assembly, and more particularly, to a socket assembly capable of maintaining stable coupling between two coupled connectors.

2. Description of the Related Art

In a typical socket assembly, a female connector is disposed in an electronic device and a male connector is usually disposed at one end of a cable. The other end of the cable is connected to an external electronic device. With the electrical connection between two connectors (i.e., the female connector and the male connector), data can be transmitted between the two electronic devices. However, especially in a high definition multimedia interface (HDMI) socket assembly, the female connector and the male connector are connected only by press-fit which cannot ensure a stable connection therebetween. Even slightly pulling the cable can cause the connectors to become disengaged from each other.

BRIEF SUMMARY

One embodiment of the present invention provides a socket, a connection terminal, and a snap-fit member. The connection terminal is plugged into the socket. The snap-fit member comprises a main body, a positioning portion, and a snap-fit portion, the positioning portion and the snap-fit portion being connected to the main body, the positioning portion being locked with the socket, the main body being pivotable between a first position and a second position about the portioning portion. The snap-fit portion is snappingly engaged with the connection terminal when the snap-fit portion is in the first position and the snap-fit portion is disengaged from the connection terminal when the snap-fit portion is in the second position.

In one aspect, the socket comprises a first housing and a plurality of first pins disposed in the first housing.

In another aspect, the first housing comprises a complementary positioning portion locked with the positioning portion.

In another aspect, the positioning portion comprises an extending tab extending from the main body away from the main body, the complementary portioning portion has a locking slot, and the extending tab is locked into the locking slot.

In another aspect, the first housing has a through hole, and the snap-fit portion passes the through hole to be snappingly engaged with the connection terminal.

In another aspect, the connection terminal comprises a second housing and a plurality of second pins disposed in the second housing.

In another aspect, the second housing comprises a locking portion snappingly engaged with the snap-fit portion.

In another aspect, the snap-fit portion comprises a barb, the locking portion has a locking opening, and the barb is snappingly engaged into the locking opening.

In another aspect, the snap-fit member is disposed on one side of the socket, and the second pins extend out of the socket from the other side of the socket.

In another aspect, the socket is a female high definition multimedia interface (HDMI) connector and the connection terminal is a male HDMI connector.

In another aspect, the main body comprises a connection portion and an operating portion, the connection portion is connected to the positioning portion and the snap-fit portion, and the operating portion and the connection portion form at least one angle therebetween.

Another embodiment of the present invention provides a socket assembly for allowing plugging of a connection terminal. The socket assembly comprises a socket and a snap-fit member. The snap-fit member includes a positioning portion and a snap-fit portion. The snap-fit member is locked to the socket by the positioning portion such that the snap-fit member is pivotable between a first position and a second position about the positioning portion. The snap-fit portion snappingly locks a plugged connection terminal to the socket when the snap-fit member is in the first position. The snap-fit portion does not interfere with the plugged connection terminal when the snap-fit member is in the second position.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1A:
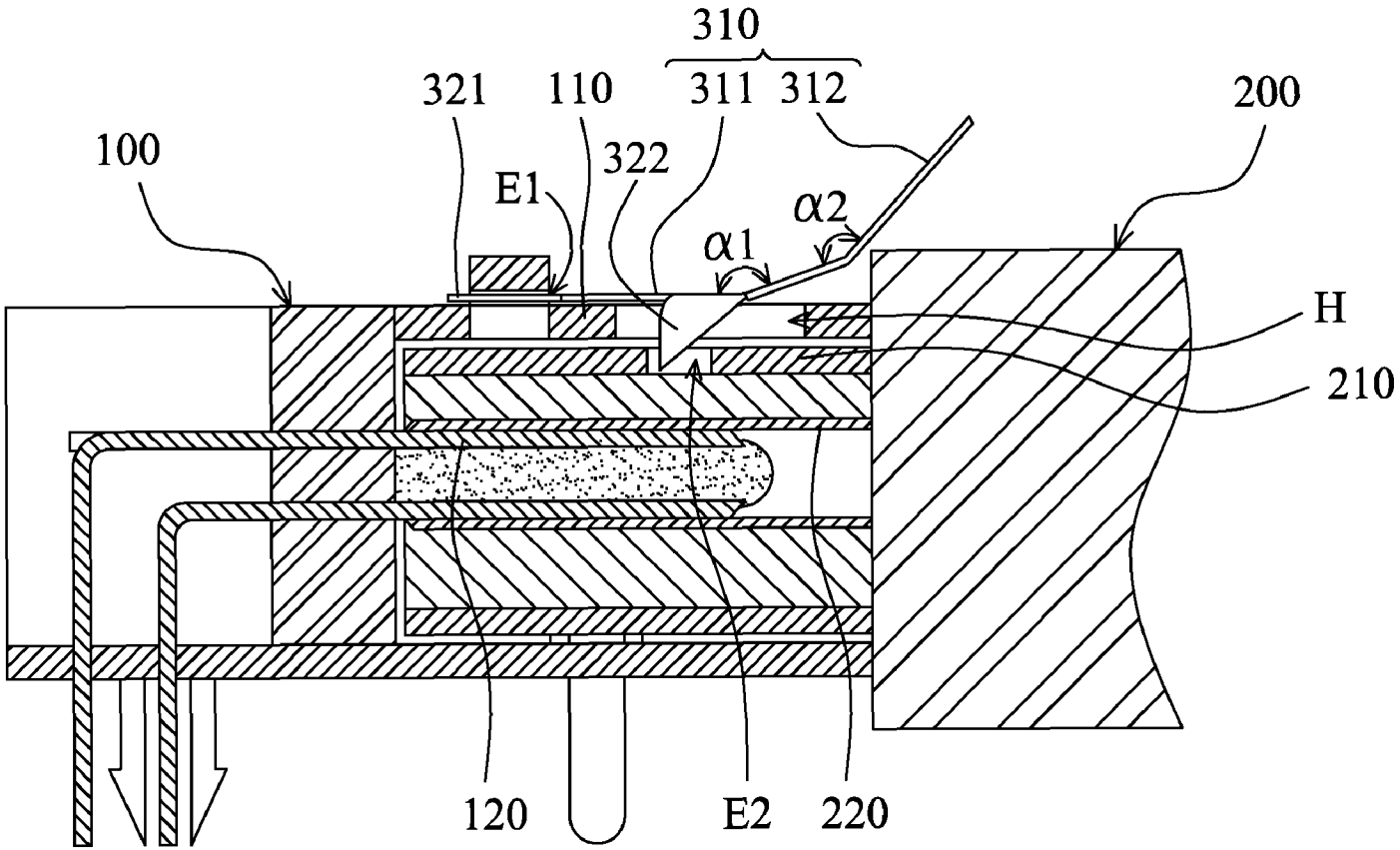
FIG. 1A and FIG. 1B are operational, cross-sectional views of a socket assembly of one embodiment of the present invention.
Figure 1B:
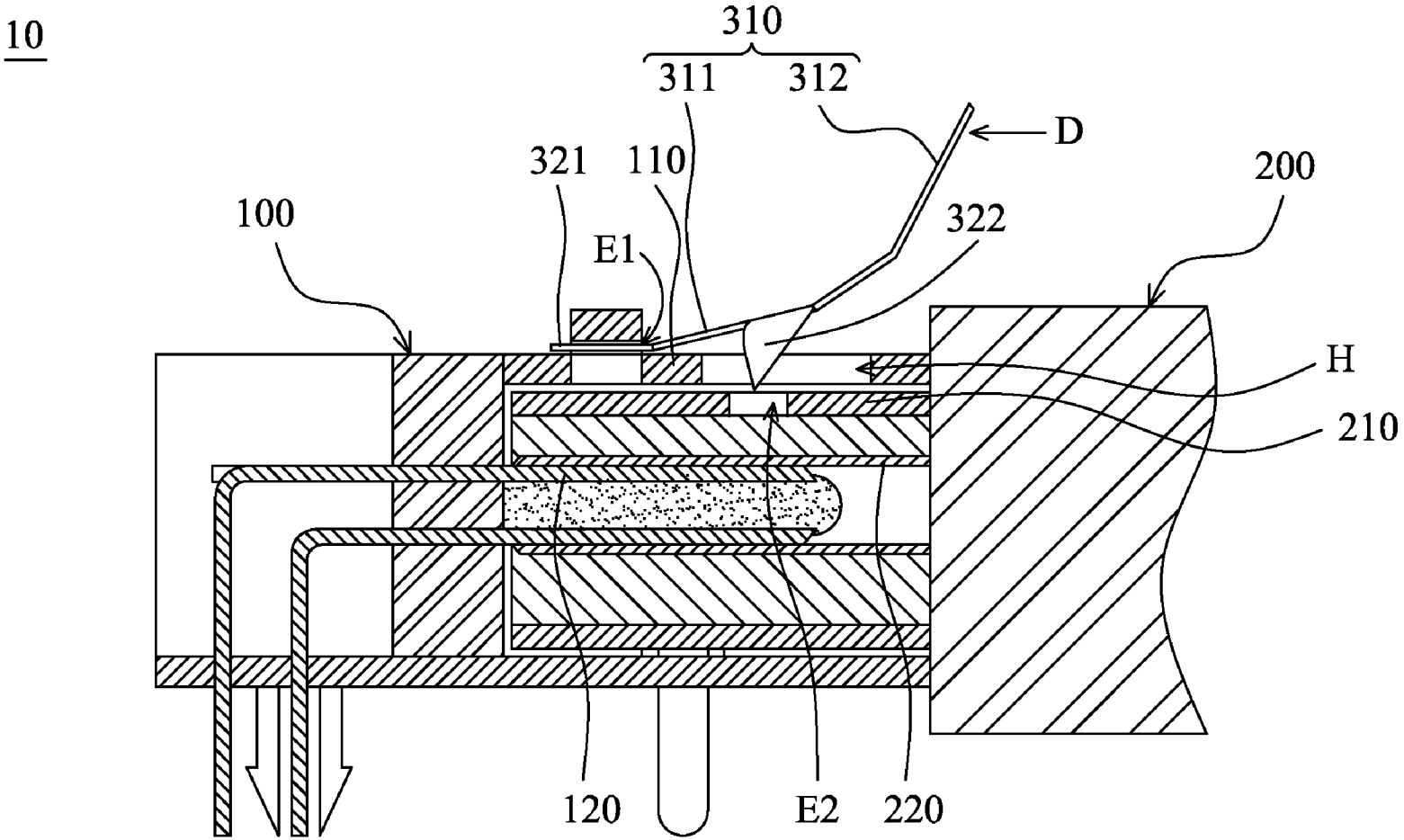

Referring to FIG. 1A and FIG. 1B, a socket assembly 10 in accordance with one embodiment of the present invention includes a socket 100, a connection terminal 200, and a snap-fit member 300. Typically, the socket 100 is disposed in an electronic device, acting as a port of the electronic device; the connection terminal 200 is formed at one end of a cable, acting as a plug of the cable. The electronic device can be electrically connected with an external electronic device connected to the other end of the cable by plugging the connection terminal 200 into the socket 100.

Figure 2:
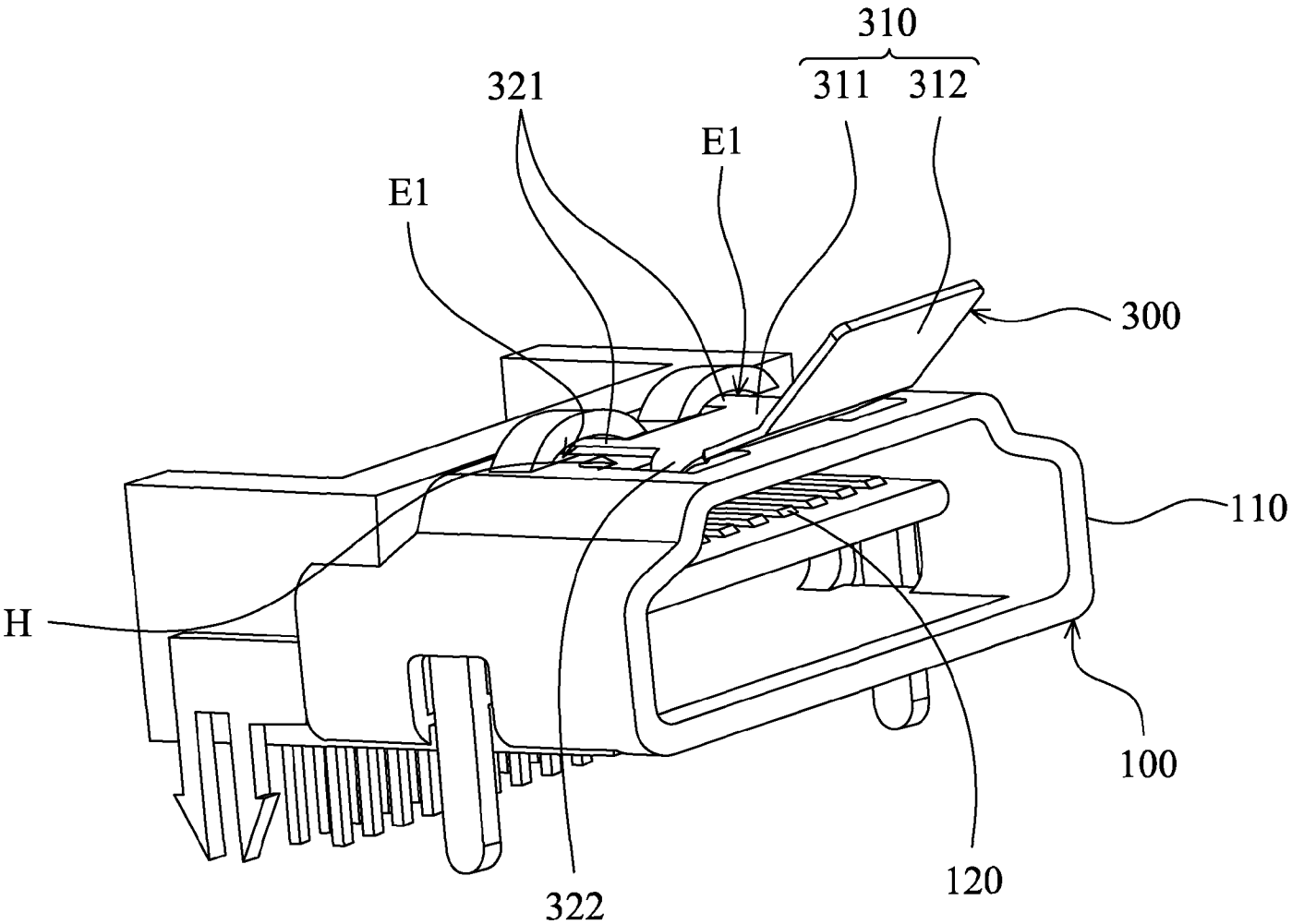
FIG. 2 illustrates a socket and a snap-fit member of the socket assembly.
Figure 3:
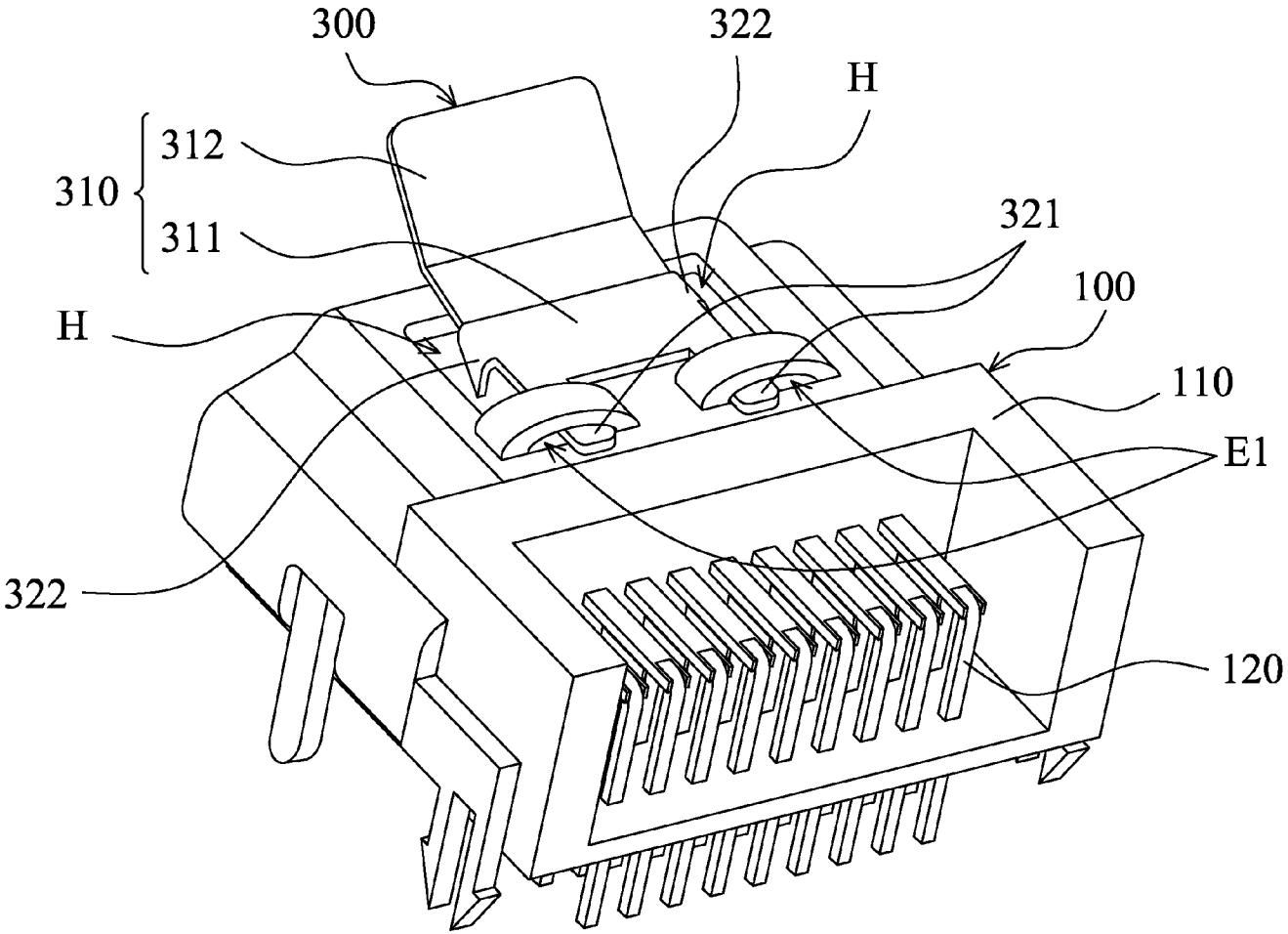
FIG. 3 illustrates the socket and snap-fit member, but viewed from another aspect.

Referring to FIG. 2 and FIG. 3, the socket 100 of the present embodiment is a female HDMI connector including a first housing 110 and a plurality of first pins 120. The snap-fit member 300 is disposed on one side of the first housing 110. The first pins 120 disposed in the first housing 110 (shown in FIG. 2) extend out of the first housing 110 from the other side thereof (shown in FIG. 3) so as to be connected with a circuit board of the electronic device.

As shown in FIG. 1A and FIG. 1B, the connection terminal 200 is a male HDMI connector including a second housing 210 and a plurality of second pins 220 disposed in the second housing 210. When the connection terminal 200 is plugged into the socket 100, the second pins 220 can contact with the first pins 120.

As shown in FIG. 2 and FIG. 3, the snap-fit member 300 includes a main body 310, a positioning portion 321 and a snap-fit portion 322. The main body 310 includes a connection portion 311 and an operating portion 312. A bend of a first angle $\alpha$1 and a bend of a second angle $\alpha$2 (shown in FIGS. 1A, 1B) are formed between the connection portion 311 and the operating portion 312. The positioning portion 321 is connected to the connection portion 311 and includes two tabs each extending from the main body 310 away from the main body 310. The snap-fit portion 322 is connected to the connection portion 311 and includes two barbs.

In addition, the first housing 110 of the socket 100 includes a complementary positioning portion E1 and two through holes H. The complementary positioning portion E1 includes two locking slots. The snap-fit member 130 is locked to the socket 100 by the engagement of the positioning portion 321 (the two extending tabs) with the complementary positioning portion E1 (the two locking slots). Since the extending tabs can slightly deform, the snap-fit member 300 is capable of pivoting between a first position (as shown in FIG. 1A) and a second position (as shown in FIG. 1B) about the positioning portion 321.

As shown in FIG. 1A and FIG. 1B, more specifically, the snap-fit member 300 stays in the first position (as shown in FIG. 1A) in the event of no external force. When a user pushes the operating portion 312 in a direction D, the snap-fit member 300 can be pivoted from the first position to the second position (as shown in FIG. 1B). In addition, provision of the first angle $\alpha 1$ and the second angle $\alpha 2$ between the connection portion 311 and the operating portion 312 of the main body 310 can decentralize the pushing force applied on the operating portion 312. While the number of the angles is two in the illustrated embodiment, it is noted that the number of the angles could be one or more than two in alternative embodiments.

In addition, the second housing 210 of the connection terminal 200 includes a locking portion E2. In the present embodiment, the locking portion E2 includes two locking openings. When the connection terminal 200 is plugged into the socket 10, the two locking openings of the locking portion E2 can align with the two through holes H of the first housing 110, respectively.

Furthermore, as shown in FIG. 1A, when the snap-fit member 130 stays in the first position, the snap-fit portion 322 is positioned in the through holes H. During plugging of the connection terminal 200 into the socket 100, the second housing 210 is pushed into the first housing 110 along a taper plane (the snap-fit portion 322) of the barbs, and the snap-fit portion 322 of the snap-fit member 300 can pass the through holes H so as to be snappingly engaged with the locking portion E2. At this time, the barbs of the snap-fit portion 322 can limit the relative movement between the connection terminal 200 and the socket 100 thus maintaining them in the coupling state. As shown in FIG. 1B, when the user pushes the operating portion 312 in the direction D, the snap-fit portion 300 can be pivoted from the first position to the second position which permits disengagement of the snap-fit portion 322 from the locking portion E2, i.e., the snap-fit portion 322 does not interfere with the connection terminal 120. At this time, the connection terminal 120 can be removed from the socket 110 simply by pulling the connection terminal 120.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A socket assembly comprising:

a socket;

a connection terminal plugged into the socket; and a snap-fit member comprising a main body, a positioning portion, and a snap-fit portion, the main body having a connection portion and an operating portion formed at one distal end of the snap-fit member, the positioning portion and the snap-fit portion being connected to the main body, the snap-fit portion being extended from the connecting portion to pass into the socket to be engaged with the connection terminal, the positioning portion being locked with the socket, the snap-fit member being pivotable between a first position and a second position about the positioning portion when a user pushes the operating portion;

wherein the snap-fit portion is snappingly engaged with the connection terminal when the snap-fit portion is in the first position and the snap-fit portion is disengaged from the connection terminal when the snap-fit portion is in the second position.

2. The socket assembly according to claim 1, wherein the socket comprises a first housing and a plurality of first pins disposed in the first housing.

3. The socket assembly according to claim 2, wherein the first housing comprises a complementary positioning portion locked with the positioning portion.

4. The socket assembly according to claim 3, wherein the positioning portion comprises an extending tab extending from the main body away from the main body, the complementary positioning portion has a locking slot, and the extending tab is locked into the locking slot.

5. The socket assembly according to claim 2, wherein the first housing has a through hole, and the snap-fit portion passes the through hole to be snappingly engaged with the connection terminal.

6. The socket assembly according to claim 2, wherein the connection terminal comprises a second housing and a plurality of second pins disposed in the second housing.

7. The socket assembly according to claim 6, wherein the second housing comprises a locking portion snappingly engaged with the snap-fit portion.

8. The socket assembly according to claim 7, wherein the snap-fit portion comprises a barb, the locking portion has a locking opening, and the barb is snappingly engaged into the locking opening.

9. The socket assembly according to claim 8, wherein the first housing has a through hole, when the connection terminal is plugged into the socket, the locking opening is aligned with the through hole such that the barb passes the through hole and is snappingly engaged into the locking opening.

10. The socket assembly according to claim 2, wherein the snap-fit member is disposed on one side of the socket, and the second pins extend out of the socket from the other side of the socket.

11. The socket assembly according to claim 1, wherein the socket is a female high definition multimedia interface (HDMI) connector and the connection terminal is a male HDMI connector.

12. The socket assembly according to claim 1, wherein the main body comprises a connection portion and an operating portion, the connection portion is connected to the positioning portion and the snap-fit portion, and the operating portion and the connection portion form at least one angle therebetween.

13. A socket assembly for allowing plugging of a connection terminal, comprising:

a socket; and a snap-fit member comprising a positioning portion, a snap-fit portion, a connection portion and an operating portion formed at one distal end of the snap-fit member, the snap-fit portion being extended from the connecting portion to pass into the socket to be engaged with the connection terminal, the snap-fit member being locked to the socket by the positioning portion such that the snap-fit member is pivotable between a first position and a second position about the positioning portion when a user pushes the operating portion;

wherein the snap-fit portion snappingly locks the connection terminal to the socket when the snap-fit member is in the first position, and the snap-fit portion does not interfere with the plugged connection terminal when the snap-fit member is in the second position.

14. The socket assembly according to claim 13, wherein the socket has a through hole allowing the snap-fit portion to pass the through hole.

15. The socket assembly according to claim 13, wherein the connection terminal comprises a locking portion to be snappingly engaged with the snap-fit portion.

16. The socket assembly according to claim 13, wherein the snap-fit portion has a barb.

17. The socket assembly according to claim 13, wherein the socket is an HDMI socket.

18. The socket assembly according to claim 13, wherein the plugged connection terminal is an HDMI connection terminal.

* * * * *